US007031481B2

(12) United States Patent
Mortensen

(10) Patent No.: US 7,031,481 B2
(45) Date of Patent: Apr. 18, 2006

(54) HEARING AID WITH DELAYED ACTIVATION

(75) Inventor: Rene Mortensen, Copenhagen (DK)

(73) Assignee: GN Resound A/S, Taastrup (DK)

( * ) Notice: Subject to any disclaimer, the term of this patent is extended or adjusted under 35 U.S.C. 154(b) by 134 days.

(21) Appl. No.: 10/359,915

(22) Filed: Feb. 7, 2003

(65) Prior Publication Data

US 2004/0156516 A1 Aug. 12, 2004

(51) Int. Cl.
*H04R 25/00* (2006.01)

(52) U.S. Cl. ..... 381/312; 381/314; 381/323

(58) Field of Classification Search ..... 381/23.1, 381/60, 312, 314, 315, 320, 321, 323; 600/559; 700/94, 86, 87
See application file for complete search history.

(56) References Cited

U.S. PATENT DOCUMENTS

| | | | | |
|---|---|---|---|---|
| 4,737,669 | A | 4/1988 | Austin | 307/592 |
| 6,741,712 | B1 * | 5/2004 | Bisgaard | 381/312 |

FOREIGN PATENT DOCUMENTS

| | | |
|---|---|---|
| DE | 19526175 C1 | 7/1995 |
| JP | 04286721 | 1/1992 |
| WO | WO 00/41440 | 7/2000 |

* cited by examiner

*Primary Examiner*—Huyen Le
(74) *Attorney, Agent, or Firm*—Michael J. Bolan; Bingham McCutchen LLP

(57) ABSTRACT

A hearing aid comprises a microphone, a sound transducer, an amplification signal path configured for coupling the sound transducer to the microphone; and a circuit configured for completely or partly blocking the signal path during a comfort delay period, which may be adjustable, when the hearing aid is switched on. It can hereby be avoided that the hearing aid transmits a disturbing howling tone during the period until it is placed correctly at or in the ear of the user, if the user switches on the hearing aid before it is correctly positioned. The circuit is further configured for generating and transmitting a special acoustic signal to the sound transducer during at least a portion of the comfort delay period. In this way a user will be able to ascertain whether the hearing aid is switched on and that it functions as it should.

24 Claims, 2 Drawing Sheets

HEARING AID WITH DELAYED ACTIVATION

RELATED APPLICATION DATA

This application is a continuation of PCT Patent Application PCT/DK01/00533, filed Apr. 4, 2001, which claims priority from Danish Patent Application PA 2000 01197, filed Aug. 10, 2000.

FIELD OF THE INVENTION

The invention relates to hearing aids, and in particular, hearing aids worn by users for the purpose of correcting hearing impairments.

BACKGROUND OF THE INVENTION

Hearing aids are normally divided into three categories: behind the ear (BTE) aids, in the ear (ITE) aids, or completely in the canal (CIC) aids. From the purely technical point of view, such hearing aids can be configured as so-called analog aids, as digital aids, or as aids with a combination of analog and digital techniques. The present invention can be used in connection with almost any form of hearing aid.

When a user switches on a hearing aid before it is positioned correctly at or in the ear, a high howling tone frequently arises because acoustic coupling between the sound transducer, i.e., a miniature loudspeaker, and the sound receiver, i.e., a microphone, makes the aid oscillate. This howling tone stops when the hearing aid is positioned correctly on or in the user's ear. BTE and ITE hearing aids usually have a mechanical on/off arrangement, e.g. a push-button, so that the user can wait to switch the aid on until it is correctly placed, thereby avoiding the oscillation. However, in order to ascertain whether the aid is functional, and whether there is a usable battery in the hearing aid, many users switch the hearing aid on before it is positioned at or in the ear. CIC hearing aids are so small that they rarely have a specific on/off arrangement. Such aids are switched on when a battery is inserted in the battery compartment and the battery cover is subsequently closed. When the battery cover is closed, the hearing aid is immediately switched on. That is, these types of aids are switched on before they are placed in the ear canal. The user can, thus, not avoid the howling tone until the aid is in place, which can be very troublesome. The howling tone can be extremely disturbing, especially for users of CIC hearing aids, since these are often used by people with a slight or a moderate hearing loss.

To facilitate the understanding of the invention initially the following definitions are given: "Start up period" is a time period that consists of the sum of two parts, namely, an "inherent delay period" and a "comfort delay period".

The "inherent delay period" depends on the electronic design of the hearing aid, and the inherent delay is usually minimized during the design phase. If the hearing aid involved is of the analog type, a charging of supply and coupling capacitors, and possibly other components, must take place before the aid is completely functional. If the aid involved is of the digital type, programs or parts thereof must be read from non-volatile storage areas and transferred to volatile memory areas, such as program RAM and/or data RAM. The inherent delay period for a hearing aid is usually, at the most, around 0.5 seconds, and up to approximately 1 second for digital aids, during which program instructions and program data must be read. Efforts are being made, however, to make digital hearing aids functional within the range of 0.5–1 seconds or less.

The "comfort delay period" is an additional time delay period wherein the acoustic signal from the microphone is, partly or wholly, prevented from reaching the sound transducer.

SUMMARY OF THE INVENTION

By configuring a hearing aid according to a first aspect of the invention, the hearing aid comprises means that generate a special acoustic signal during at least a portion of the comfort delay period, so that the user is informed about the delay function, and does not think that the aid is defective, that the battery is empty, or that the aid is incorrectly set. So, instead of attempting to adjust the aid during the delay period, perhaps setting it incorrectly, the user will wait for the aid to function. In other words, the user can ascertain, i.e. hear, that the aid is switched on and that it functions as it should, and in a number of seconds will be completely ready and functional. It is noted, that in a prior art device, such as disclosed in DE 19526175, the device is silent during the delay period, leaving a user in doubt as to whether the device is able to function or not.

The characteristics of the special acoustic signal may be programmable, so that it is possible to input a preselected acoustic signal, via, for example, a PC, which is adapted to certain user demands. For example, the signal can be formed so that the user can ascertain how great a part of the comfort delay period there remains. This special acoustic signal can, e.g., be a series of short tones ("beeps") at periodic intervals. The characteristics of the special acoustic signal can be programmable in dependence of the user's audiogram, so that it is possible to adapt the acoustic signal in a way that the acoustic signal comprises tones that are naturally at a frequency and with a sound pressure that can be heard by the user. Thus, it is possible to fine adjust the special acoustic signal, e.g., by adjusting the level of the individual frequency components in the signal as function of time. It is also possible to reduce the interval between the "beeps" in the signal so that they arrive more frequently, or conversely so that they arrive more infrequently, as the end of the comfort delay period is approached.

The aid may comprise amplification means adapted for reducing an amplification of the hearing aid during the comfort delay period, thereby avoiding troublesome oscillation in a simple manner. A suitable down-regulation of the amplification may be achieved, depending on the type of hearing aid involved, the setting of the hearing aid, the user's hearing impairment, etc., so that a completely individual setting is achieved for the individual hearing aid user.

It is preferred-that the comfort delay period is greater than 1 second, preferably 5–20 seconds, in order to adapt the aid to various users having different wishes.

In accordance with another aspect of the invention, efforts are also directed, such that, instead of making the comfort delay period of the aid as short as possible, the length of the comfort delay period is adjustable. The hearing aid can be adjusted to be completely or partly silent for a sufficient time until it has been positioned correctly. The user can thus avoid hearing the howling tone directly in the ear, even though the hearing aid has been switched on before it is positioned correctly at or in the ear. Thus, a comfort delay period will be provided for an individual user's demands or needs.

Especially with hearing aids without on/off switch, the period must be sufficiently long that the user, after having inserted the battery and hereby having switched on the aid, is able to place it correctly in the ear canal before the aid functions as it is has been set with regard to amplification, frequency response, etc. It is further noted that new users of hearing aids will need a long comfort delay period, but gradually, as they become experienced in switching the aid on and placing it in position, may be satisfied with a shorter period. The length of the comfort delay period can also depend on the age of the user, or on how long the user has had the hearing aid. The length of the comfort delay period is set or chosen, e.g., during the user's preliminary examination at the audiologist or the like, where the user can, e.g., try different lengths of delay periods.

The length of the comfort delay period may be reduced based on an accumulated utilization time of the hearing aid. In this way the length of the comfort delay period will be reduced automatically, e.g. by some percent, each time the aid has been switched on a certain number of times since the last comfort delay period reduction. This possible, automatic reduction may cease at a determined limit, e.g., when the comfort delay period has been halved in relation to the starting point. Thus, when a user get more experienced in the use of his hearing aid, and then need less time for the comfort delay period, then the hearing aid automatically reduces the comfort delay period.

The setting of the comfort delay period and the characteristics of the special acoustic signal can naturally also be selected by reducing the comfort delay period from a first length to a final second length, and carried out when the user consults the dealer, the audiologist or other qualified people who have fitting equipment for the hearing aid. The setting can be individual, such that the signal tones transmitted are at a level and frequency that are optimal for the user. For example, the fitting equipment can be arranged in such a manner that it automatically selects a signal type and level on the basis of the user's own audiogram.

In the testing of the invention, it has proved that many users have a need for a comfort delay period having a first length in the range of 10–20 seconds and a second and final length in the range of 3–9 seconds. By configuring the hearing aid with a digital circuit having digital storage facilities and means for the generation of a time-dependent signal or a clock function, and a program sequence for controlling the length of the comfort delay period and/or the characteristic of the special acoustic signal, a comfort delay period of the desired length and a special acoustic signal is obtained in a simple manner.

Within the scope of this invention, almost all requirements will be able to be covered for the different types of users and different types of hearing aids.

BRIEF DESCRIPTION OF DRAWINGS

In the following, a preferred embodiment of the invention is explained in more detail with reference to the drawings, where.

DETAILED DESCRIPTION OF THE PREFERRED EMBODIMENT

Figure 1:
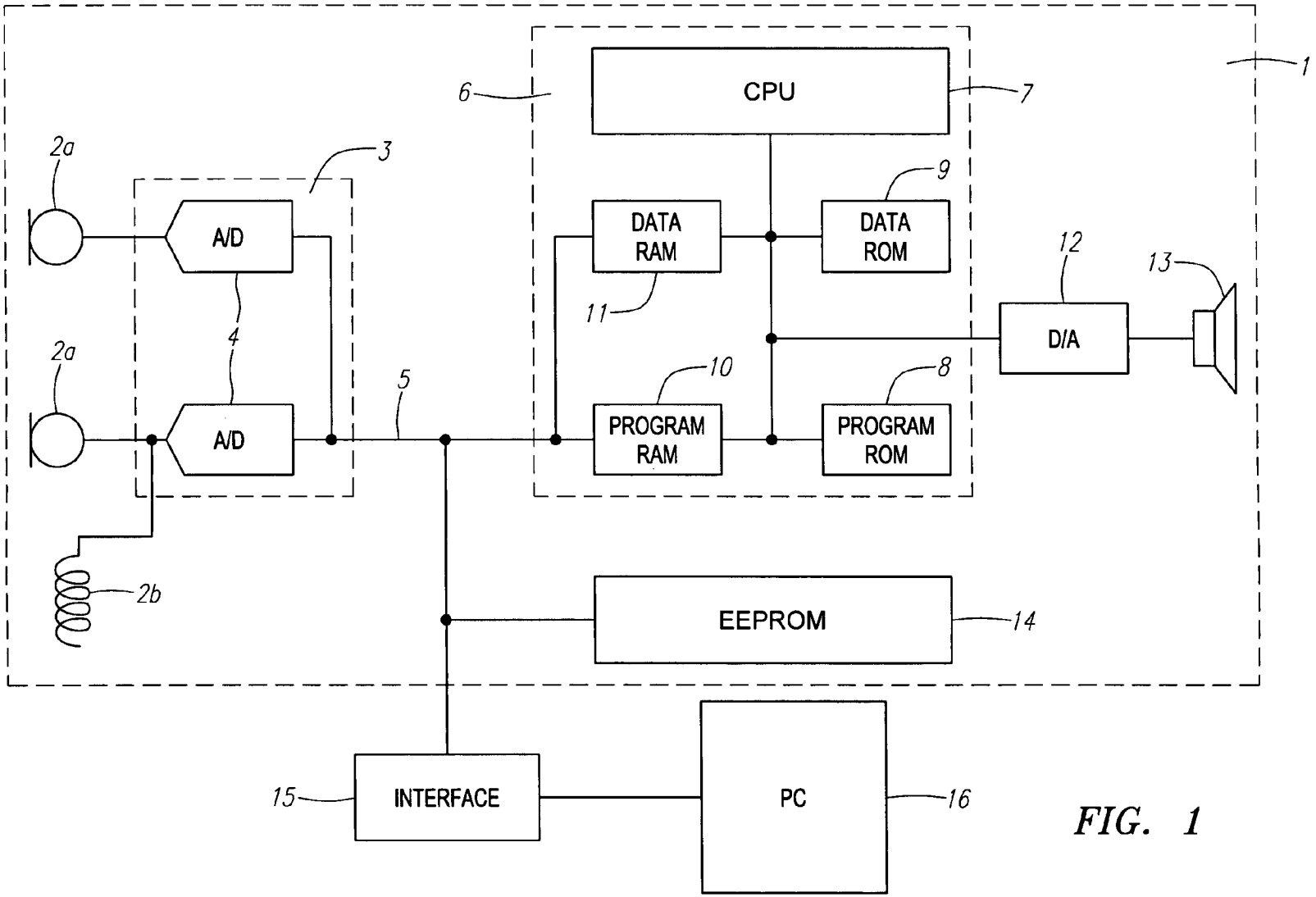
FIG. 1 shows a simplified block diagram of a digital hearing aid with comfort delay period according to the invention.

The invention will now be described in more detail in connection with a fully digital hearing aid 1, e.g., a programmable CIC hearing aid. An example of such a hearing aid according to the invention is shown schematically in block diagram form in FIG. 1. The hearing aid 1 comprises one or more sound receivers 2, which in the illustrated example, takes the form of two microphones 2*a* and a telecoil 2*b*. The analog signals for the microphones are coupled to an analog-digital converter circuit 3, which comprises an analog digital converter 4 for each of the microphones.

The digital signal outputs from the analog-digital converters 4 are coupled to a common data line 5, which leads the signals to a digital signal processing and adapter circuit 6. This circuit, which, for example, can be in the form of a digital signal processor (DSP), and which is explained in more detail later, is programmed to effect the necessary operations on the digital signals with the view to carrying out the necessary adaptation of the signals, and to adjust the hearing aid 1 for the relevant user. The output signal is then fed to a digital-analog converter 12, from which analog output signals are fed to a sound transducer 13, such as a miniature loudspeaker.

In addition, externally in relation to the digital signal processing and adapter circuit 6, the hearing aid 1 contains a storage unit 14, which in the illustrated example, is an EEPROM (electronically erasable programmable read-only memory). This external memory 14, which is connected to a common serial data bus 17, can be provided via an interface 15 with programs, data, parameters, etc. entered from a PC 16. This will be the case, for example, when a new hearing aid is allotted to a specific user, where the hearing aid is adjusted for precisely this user, or when a user has his hearing aid updated and/or re-adjusted to the user's actual hearing loss, e.g., by an audiologist.

The digital signal processing and adapter circuit 6 comprises a central processor (CPU) 7 and a number of internal storage units 8–11, and in particular, a program ROM (read-only memory) 8, a data-ROM 9, a program RAM (random access memory) 10, and a data-RAM 11. The two first-mentioned contain programs and data that constitute permanent elements in the circuit, while the two last-mentioned contain programs and data that can be changed or overwritten.

The external EEPROM 14 is normally considerably larger, e.g., 4–8 times larger, than the internal RAM, which means that certain data and programs can be stored in the EEPROM so that, when there is need for it, they can be read into the internal RAMs for execution in a manner that allows these special data and programs can thus later be overwritten again by the normal operational data and working programs. The external EEPROM can thus contain a series of programs that are used only in special cases, such as, e.g., start-up programs.

Figure 2:
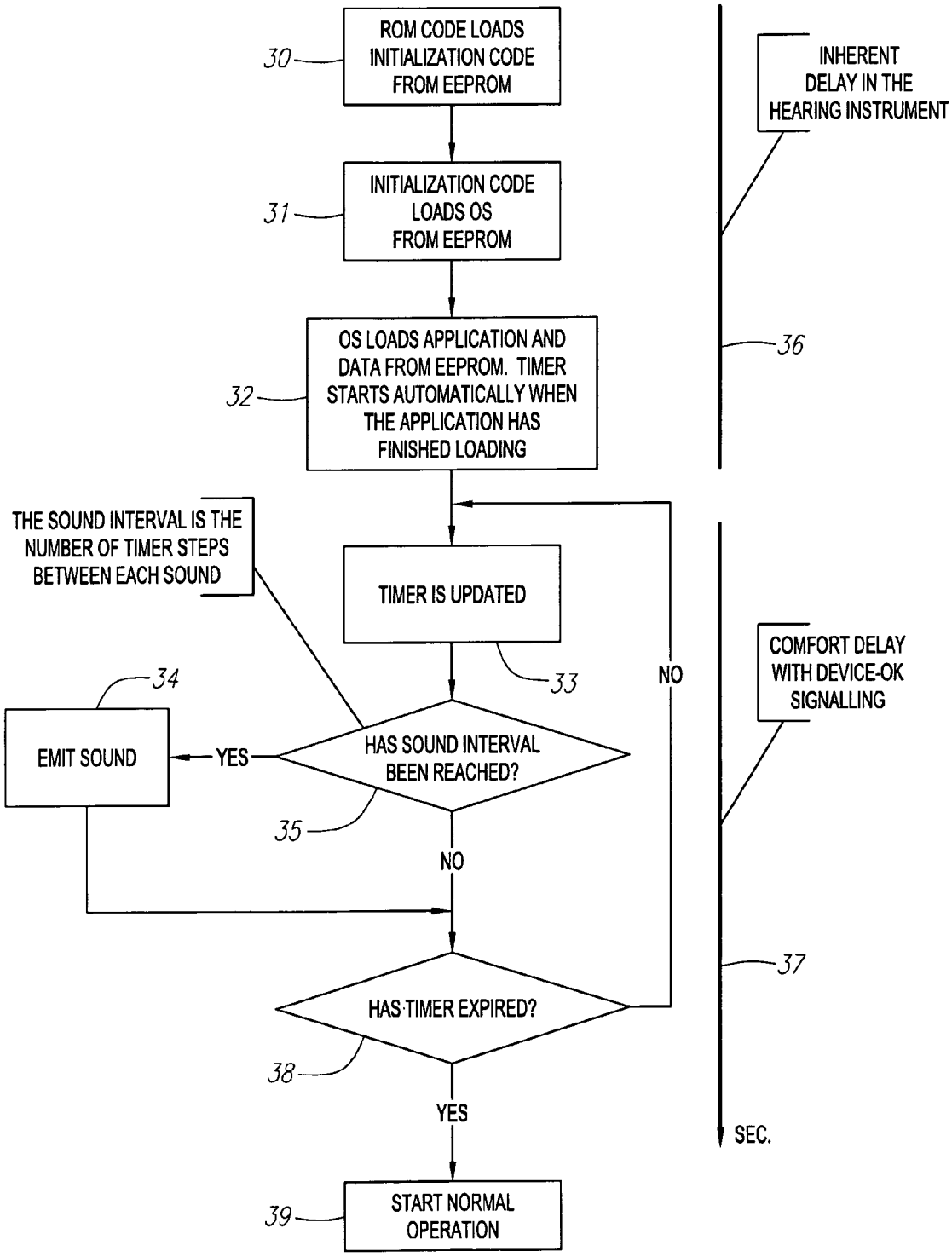
FIG. 2 is a flow diagram showing the start-up phase for the hearing aid in FIG. 1.

For an explanation of how the invention is implemented in the hearing aid 1, reference is made to the flow diagram in FIG. 2. When the hearing aid 1 is switched on, either by means of a regular, built-in switch, e.g., a pushbutton, or in the case of a CIC hearing aid, by opening the battery cover, inserting a battery, and closing the cover again, the inherent delay period, which is shown at the uppermost, right-hand side of the diagram and extending from the top and downwards along the symbolic time axis, is started (flow 36).

Hereafter, a start code from the external EEPROM 14 is transferred to the program RAM block 10 (block 30). This start code gives rise to the transfer of an operating system from EEPROM 14 to the DSP circuit 6 (block 31), after which, the program application and its associated data are transferred by the operating system from EEPROM 14 (block 32), so that the DSP circuit 6 is now completely operative and has been supplied with the necessary programs and data to customize the hearing aid 1 for the individual user. Accordingly, the hearing aid 1 is fully operative and, if not placed in position in the user's ear canal, will oscillate due to the coupling between the transducer 13 and the microphones 2. At the same time, however, the signal path from the microphone 2 to the transducer 13 is blocked by one or several program instructions in the programmable DSP 6.

In addition to the inherent delay period (flow 36), the hearing aid 1 is programmed to implement a comfort delay period (flow 37), which is shown at the lowermost, right-hand side of the diagram and extending from the top and downwards along the symbolic time axis, and generate an acoustic signal to notify the user that the hearing aid 1 is switched on and that it is operative, but that the comfort delay period has not yet expired. In particular, at the same moment that the external memory 14 has transferred the program application and its associated data to DSP 6, a timer is automatically started in the DSP 6 (block 32). The timer sequence starts and a count is effected from a value equal to the number of seconds for which the comfort delay period is set down to 0 (blocks 33, 38). When the timer has reached the expiry of the comfort delay period, the hearing aid 1 is returned to normal (block 39).

In the case shown, the timer is also used to generate the acoustic signal as a series of short acoustic beeps (block 34) with a suitable frequency (block 35) by programming the hearing aid 1 with the number of timer steps required between each beep.

If changes in the comfort delay period (flow 37) or in the sound controlled by block 34 with regard to sound level, frequency, length of interval, etc., are desired, the program sequence or the parameters of sequence can be modified by overwriting them.

If the signal path from the microphone 2 to the transducer 13 is not desired to be blocked completely, but it is desired instead to reduce the hearing aid's amplification, e.g., by 40–50 dB, this can also be effected in a programmable manner independently of the sound level of the special acoustic signals controlled by block 34. If, on the other hand, the hearing aid involved is of the analog type or a hearing aid with combined analog and digital techniques, the comfort delay period can be controlled by a commonly-known time constant circuit, a digital counter, or RC circuits. If the hearing aid involved is an analog aid, in practice, use will often be made of a small digital circuit with a timer for controlling and setting the comfort delay period.

It will be obvious to those familiar with the art that in practice the present invention will be able to be implemented within the framework of the invention in ways other than those explained above.

The invention claimed is:

1. Hearing aid comprising:

at least one microphone;

at least one sound transducer;

a signal path configured for coupling the at least one sound transducer to the at least one microphone; and a circuit configured for completely or partly blocking the signal path during a comfort delay period, and for generating and transmitting a signal to the sound transducer for outputting a special acoustic signal during at least a portion of the comfort delay period.

2. Hearing aid according to claim 1, wherein characteristics of the special acoustic signal are programmable.

3. Hearing aid according to claim 2, wherein the characteristics of the special acoustic signal are programmable depending on a user's audiogram.

4. Hearing aid according to any of claims 1–3, wherein the circuit is configured for partly blocking the signal path by reducing an amplification of the signal path during the comfort delay period.

5. Hearing aid according to claim 4, wherein the amount by which the amplification is reduced is set depending on a user's audiogram.

6. Hearing aid according to any of claims 1–3, wherein the comfort delay period is greater than 1 second.

7. Hearing aid according to any of claims 1–3, wherein the comfort delay period is 5–30 seconds in length.

8. Hearing aid comprising:

at least one microphone;

at least one sound transducer;

a signal path configured for coupling the at least one sound transducer to the at least one microphone; and a circuit configured for completely or partly blocking the signal path during a comfort delay period when the hearing aid is switched on, and for adjusting the length of the comfort delay period.

9. Hearing aid according to claim 8, wherein the circuit is configured for reducing the length of the comfort delay period based on an accumulated utilization time of the hearing aid.

10. Hearing aid according to claim 8, wherein the circuit is configured for reducing the comfort delay period from a first length to a second and final length.

11. Hearing aid according to claim 10, wherein the circuit is configured for setting the first length and the second and final length to respective values during an initial fitting of the hearing aid.

12. Hearing aid according to claim 10 or 11, wherein the first length has a value between 10–20 seconds, and the second and final length has a value between 3–9 seconds.

13. Hearing aid according to any of claims 8–11, wherein the circuit is further configured for generating and transmitting a signal to the sound transducer for outputting a special acoustic signal during at least a portion of the comfort delay period.

14. Hearing aid according to claim 1 or 8, wherein the circuit comprises an analog circuit.

15. Hearing aid according to claim 1 or 8, wherein the circuit comprises a digital circuit.

16. Hearing aid according to claim 15, wherein the circuit comprises a digital signal processor.

17. Hearing aid according to claim 1, wherein the special acoustic signal is configured for notifying a user that the hearing aid is switched on and operative.

18. Hearing aid according to claim 1 or 8, wherein the circuit is further configured for unblocking the signal path after expiration of the comfort delay period.

19. Hearing aid according to claim 1, wherein the circuit is further configured for unblocking the signal path and ceasing transmission of the signal to the at least one sound transducer after expiration of the comfort delay period.

20. Hearing aid according to claim 1, wherein the circuit is configured for transmitting the signal to the at least one sound transducer during the entirety of the comfort delay period.

21. Hearing aid according to claim 1 or 8, wherein the circuit has an inherent delay period, and the comfort delay period occurs after the inherent delay period.

22. Hearing aid according to claim 13, wherein the special acoustic signal is configured for notifying a user that the hearing aid is switched on and operative.

23. Hearing aid according to claim 13, wherein the circuit is further configured for unblocking the signal path and ceasing transmission of the signal to the at least one sound transducer after expiration of the comfort delay period.

24. Hearing aid according to claim 13, wherein the circuit is configured for transmitting the signal to at least one sound transducer during the entirety of the comfort delay period.

* * * * *